United States Patent [19]

Campbell et al.

[11] 4,154,168

[45] May 15, 1979

[54] FLARE RELEASE SYSTEM

[75] Inventors: John M. Campbell, Ridgecrest, Calif.; Charles R. Stribley, Scottsdale, Ariz.; Douglas G. Ewen; Ronald D. Hise, both of China Lake, Calif.

[73] Assignee: The United States of America as represented by the Secretary of the Navy, Washington, D.C.

[21] Appl. No.: 877,547

[22] Filed: Feb. 13, 1978

[51] Int. Cl.[2] ..... F42B 4/24

[52] U.S. Cl. ..... 102/37.7

[58] Field of Search ..... 102/10, 16, 19.2, 37.8, 102/37.6, 37.7; 89/1.5 R

[56] References Cited

U.S. PATENT DOCUMENTS

| | | | |
|---|---|---|---|
| 2,752,615 | 7/1956 | Parker | 102/10 |
| 2,949,853 | 8/1960 | Vogt | 102/10 |
| 3,086,464 | 4/1963 | Butler et al. | 102/10 |
| 3,336,870 | 8/1967 | Gunyan et al. | 102/37.7 |
| 3,399,621 | 9/1969 | Schillreff | 102/37.8 |
| 3,596,599 | 8/1971 | Schillreff | 102/37.4 |
| 3,709,148 | 1/1973 | Costley et al. | 102/10 |
| 3,762,327 | 10/1973 | Murray et al. | 102/37.8 |
| 3,964,393 | 6/1976 | Foote et al. | 102/37.6 |
| 4,026,188 | 5/1977 | Woodruff et al. | 89/1.5 R |

*Primary Examiner*—Charles T. Jordan

*Attorney, Agent, or Firm*—R. S. Sciascia; W. Thom Skeer; Thomas W. Hennen

[57] ABSTRACT

A flare release system in which a plurality of flares are sequentially launched from a submerged float. Launching apparatus for each flare comprises a compressed gas cylinder which is ruptured by a firing pin propelled by an electrically initiated squib. Compressed gas escaping from the cylinder powers an ejection piston to force a flare from the submerged float. An electric circuit distributes firing pulses to each flare launching mechanism according to a predetermined sequence.

11 Claims, 5 Drawing Figures

FLARE RELEASE SYSTEM

BACKGROUND OF THE INVENTION

1. Field of the Invention

This invention pertains to a system for launching bodies from a housing, and more particularly to apparatus for pneumatically launching bodies from a housing in a predetermined sequence.

2. Description of the Prior Art

Prior flare release systems have included an explosive charge to propell the flare from the housing with sufficient force to reliably achieve flare separation while the flare and housing are submerged. Accidental discharge of the explosive charge while the housing is on the deck of a ship results in the flare being launched many feet in the air. The possibility of such a flare ejection complicates handling problems and endangers crew members who may be standing over the housing.

Other prior art flare launching systems are intended to launch flares from aircraft and thus do not solve the problems associated with underwater launching of flares. Such devices usually include means for igniting the flare only after the flare clears the launcher, and often an explosive charge is used to power flare ejection.

SUMMARY OF THE INVENTION

The present invention provides safe and reliable flare ejection while the housing is submerged and yet eliminates danger to handling personnel in the event of accidental launch mechanism actuation while the housing is in air. A buoyant housing is equipped with a plurality of identical flare cavities and associated flare launching mechanisms. Each flare cavity is sealed from the ambient by a detachable end cap. Each flare launching mechanism comprises a compressed gas cylinder which is punctured by a spike propelled by an electrically initiated squib in response to a launch signal. Compressed gas escaping from the cylinder powers an ejection piston which forces the flare into the sealed cap, forcing it open, and ejecting the flare from the flare cavity. The buoyant flare then rises to the surface of the water and ignites. An electronic circuit receives fire pulses and selects and fires the electrically initiated squibs in a predetermined sequence. Flares are launched through the forward end of the buoyant housing while the housing is anchored on the sea floor. The electric circuit which determines the firing order of flares is located within the housing and adjacent the aft end.

BRIEF DESCRIPTION OF THE DRAWING

Further advantages of the present invention will emerge from a description which follows of the preferred embodiment of a flare release system according to the invention, given with reference to the accompanying drawing figures, in which.

DESCRIPTION OF THE PREFERRED EMBODIMENT

The present invention is intended to launch buoyant flares from submerged positions in the sea. Specifically, the present invention is intended to be used with buoyant flares of the type disclosed in U.S. Pat. No. 3,960,087.

Figure 1:
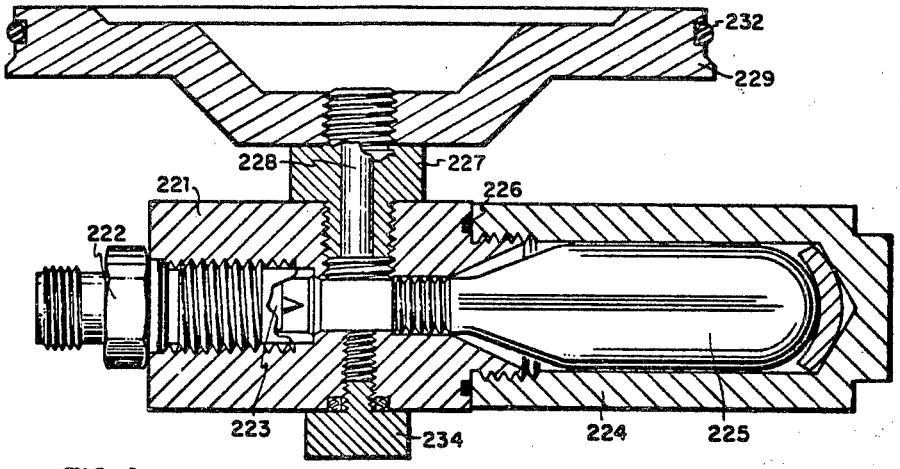
FIG. 1 is a sectional view of a flare launching mechanism according to the invention.

Referring now to FIG. 1 there is shown a single flare release mechanism as utilized in the present system. Aft bulkhead 229 having O-ring seal 232 is shown joined by union 227, having central passageway 228 with pressure housing 221. Electrically initiated squib 222 is shown threaded into pressure housing 221 and is sealed therein to prevent escape of compressed gas when the mechanism is actuated. Squib 222 powers spiked piston 223. Bottle housing 224 is threaded onto pressure housing 221 and sealed by O ring seal 226. Compressed gas cylinder or bottle 225 is contained within bottle housing 224, and contains a supply of compressed gas. Carbon dioxide gas is one economical and readily available gas that can be used, although any other compatible, non-corosive, non-flammable gas could be used with equivalent effect. Pressure housing 221 is sealed by vent plug 234 which also has an O-ring seal.

When a flare launch signal is received, squib 222 is electrically initiated and produces a quantity of high pressure gas. This gas propells spiked piston 223 into the end of compressed gas cylinder or bottle 225, releasing the gas contained therein. This released gas passes out of bottle 225 through passageway 228 and through aft bulkhead 229 to power a launching or ejection piston.

Figure 2:
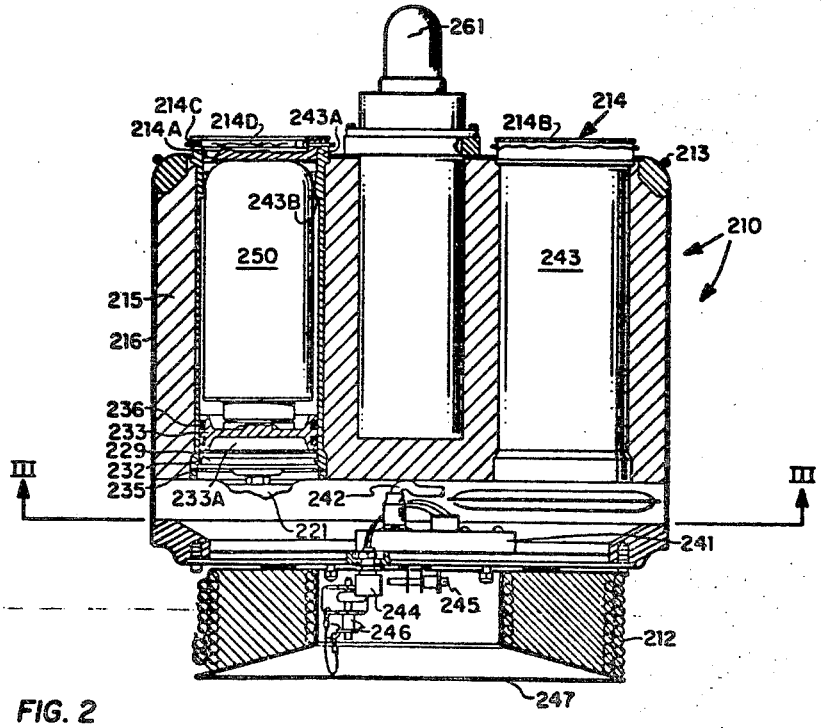
FIG. 2 is a sectional view of a buoyant housing utilizing a plurality of flare launch mechanisms according to the invention.

Referring now to FIG. 2 there is shown a buoyant flare launching platform or housing 210. Housing 210 has a plurality of flare cavities within cavity liners 243 which are sealed from communication with the ambient by detachable cap 214 which has O-ring seal 214A and covering flange 214B. Detachable cap 214 is secured in place by means of a plurality of shear pins 214C having the heads directed toward the center of cap 214, and being retained in place by safety wire 214D strung around the outside of flare cavity liner 243. Shear pins 214C are selected to shear upon application of force from compressed gas in bottle 225 as will be explained below.

Ejection piston 233, which is sealed against flare cavity liner wall 243A by O-rings 236, is slidable almost the entire length of liner 243, and is retained within liner 243 by shoulder 243B during a flare ejection. Thus, it may be seen that as compressed gas from bottle 225 passes through aft bulkhead 229, it pressurizes that portion of the flare cavity within cavity liner 243 which is designated as 233A in FIG. 2. Pressure in zone 233A causes ejection piston 233 to apply force to flare 250, which transmits force against detachable cap 214, and in doing so causes failure of shear pins 214C, detaching cap 214 and ejecting flare 250 from cavity liner 243. Since flare 250 is buoyant, after it is ejected from buoyant flare launching platform or housing 210, it rises to the surface. Buoyancy of housing 210, partially lost when piston 233 initially causes cap 214 to shear pins 214C and break the seal of O-ring 214A permitting flooding of cavity liner 243, is recovered when piston 233 is forced against shoulder 243B near the foward end of cavity liner 243.

Housing 210 is made buoyant by the inclusion of foam filler 215 or other suitable buoyant material. Outer skin 216 is joined to suitable corner members which may be constructed of aluminum or other common engineering material as is well known in the art to enclose foam material 215 and the plurality of flare launching mechanisms.

Stroboscopic beacon 261 is positioned at the forward end of housing 210 and is powered by self contained batteries stored in the center of housing 210. Beacon 261 is activated by an ambient pressure sensitive switch which enables beacon activation only after housing 210 has reached the surface of the water. Handling line 213 extends around the forward end of housing 210 and is intended to facilitate manipulation of housing 210 by scuba divers or other handling personnel.

The aft end of housing 210 includes electronic circuit 241 for sequentially firing the plurality of flares as will be described below. The flare launching mechanism illustrated in FIG. 1 is retained within flare cavity liner 243 by snap ring 235.

The base or aft end of housing 210 includes coiled line 212 which is connected between housing 210 and an anchoring body (not shown). Line 212 is attached to housing 210 by a clevis pin at 246. A second mooring line, not shown, attaches between clevis pin 245 and an anchoring body. Electronic communication between the anchoring body and electronic circuit 241 is made by an electric cable which attaches at fitting 244 to communicate fire signals to circuit 241.

Figure 3:
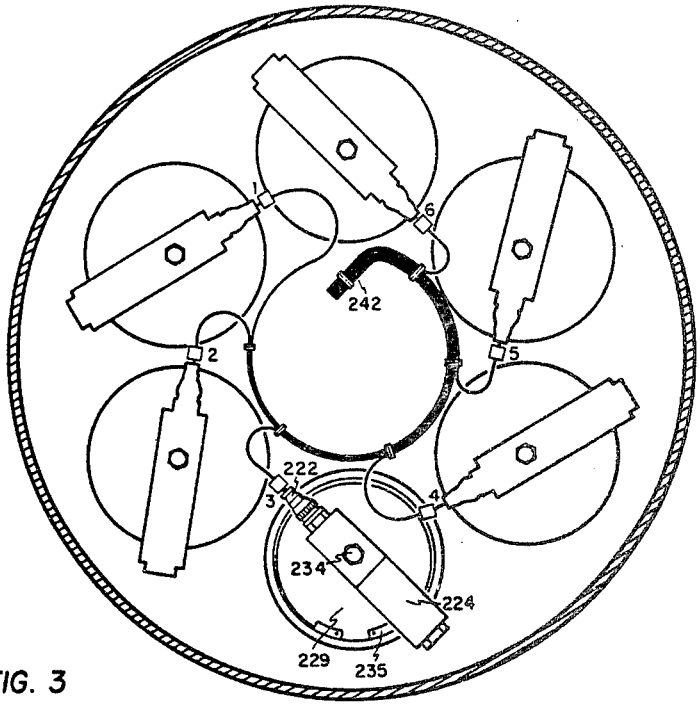
FIG. 3 is a view from inside the aft end looking forward of a buoyant housing equipped with flare launch mechanisms according to the invention.
Figure 4:
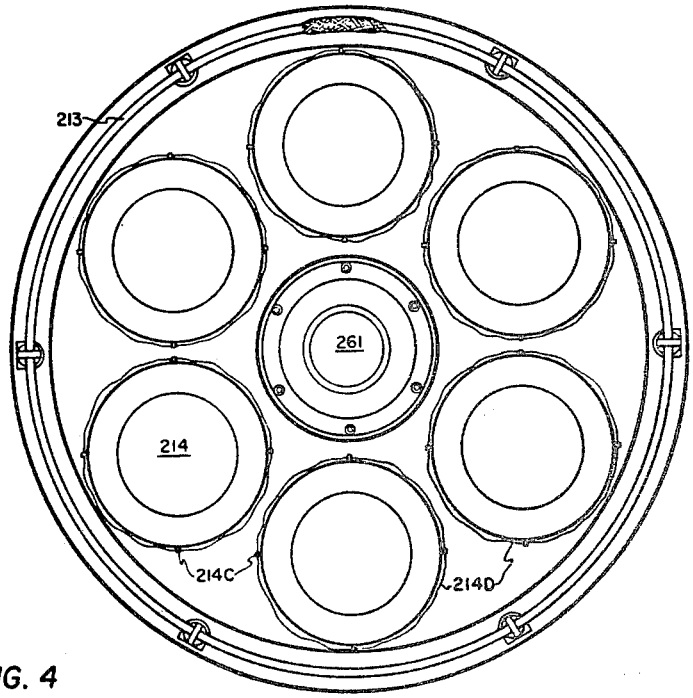
FIG. 4 is a front end view of a buoyant housing according to the invention.

Referring now to FIG. 3 there is shown the bottom or aft end of housing 210 after base 247 has been removed. Position 3 is typical of other flare positions. Referring now to FIG. 4 there is shown a top or front end view of housing 210 illustrating the arrangement of the detachable caps 214 and stroboscopic beacon 261.

Figure 5:
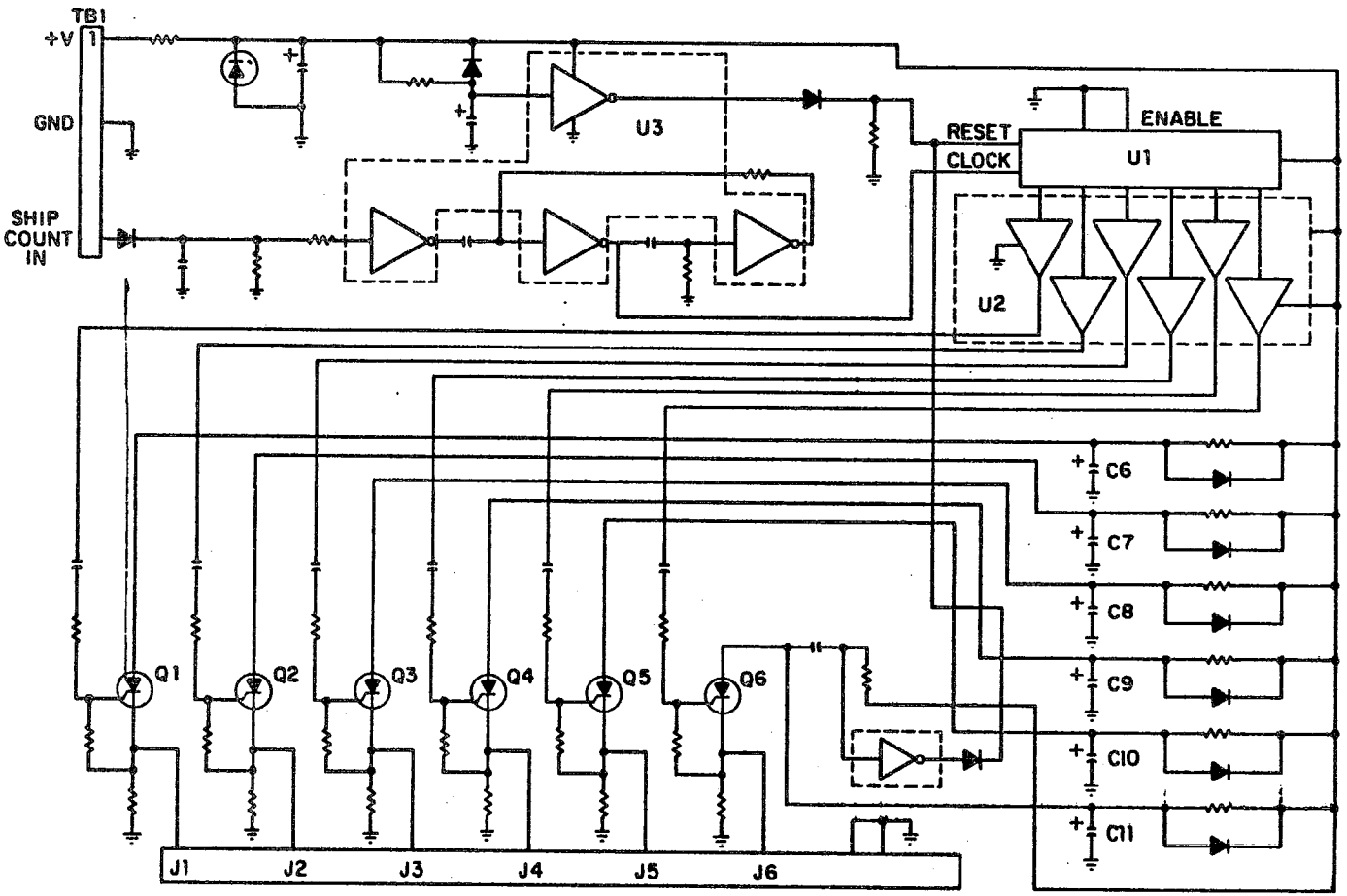
FIG. 5 is an electrical schematic diagram of the electric circuit which distributes firing pulses to the separate flare launch mechanisms according to a predetermined sequence according to the invention.

FIG. 5 illustrates the schematic electrical diagram of the flare release selector which sequentially releases flares according to a predetermined order. The present invention is intended for use in conjunction with an actuation mine simulator, and thus the electric circuit shown in FIG. 5 is activated by substantially identical fire signals applied at terminal 2 from the anchoring body mentioned above which contains apparatus for sensing the proximity of ships.

Each fire signal is processed by component U3 which may be an inverting hex buffer of the type commercially available under the number 4049A. Conventional voltage regulation circuitry are employed near 12 volt power input terminal 1 as shown in the schematic. Processed fire signals from U3 are then fed to element U1 which may be a Divide by 8 Counter/Divider of the type commercially available under the number 4022A. Component U1 sequentially sends fire signals to amplifiers within component U2, which may be a non-inverting hex buffer of the type commercially available under the number 4050A. Amplified fire signals from component U2 are sent in sequence to controlled diodes Q1, Q2, Q3, Q4, Q5 and Q6 through a capacitive and resistive network to cause each controlled diode in turn to conduct and thereby send a high energy firing pulse from capacitive network C6, C7, C8, C9, C10 or C11 to output terminals J1, J2, J3, J4, J5 or J6 in sequence. After diode Q6 has been tripped, a reset pulse is amplified and returned from component U3, shown capacitively coupled to diode Q6, to component U1 to thereby reset component U1 to its initial conditions for firing controlled diode Q1. The schematic diagram in FIG. 5 provides 6 firing pulses, one at a time, and in a predetermined sequence distributed to 6 different output terminals from a single input of substantially indentical signals at input terminal 2.

The present invention is used in the Actuation Mine Simulator System, and other inventions related thereto, filed of even date with the present invention, include the Planting and Storage Rack and Release Mechanism, Ser. No. 877,545, filed 13 Feb. 1978, the Underwater Search Coil, Ser. No. 877,546 filed 13 Feb. 1978, and the Actuation Mine Simulator, Ser. No. 879,286 filed 13 Feb. 1978. Also, U.S. Pat. No. 3,960,087 to Beatty et al. may be used within the Actuation Mine Simulator System.

Although the present ivention has been described as a flare launching system it is of course understood that the system could be used to launch any kind of self-contained, discrete component from a submerged position.

Although the preferred embodiment has been described, it will be understood that within the purview of this invention various changes may be made in the form, details, proportion, and arrangement of parts, the combination thereof and mode of operation, which generally stated results in a device capable of carrying out the features set forth, as disclosed and defined in the appended claims.

What is claimed is:

1. Apparatus for pneumatically expelling a first body from a cylindrical cavity within a second body wherein said cavity is defined by interior walls and is sealed from communication with the ambient by a detachable seal, said apparatus comprising:
   - a floating piston having first and second sides, said first side being positioned toward said seal and abutting said first body, said floating piston being slidably retained within said cavity between first and second positions and sealingly engaging the walls of said cavity;
   - a source of pressurized gas; and
   - expelling means communicating with said source of pressurized gas and said cavity, and responsive to a signal for pressurizing said cavity on said second side of said floating piston.

2. Apparatus as set forth in claim 1 wherein said source of pressurized gas comprises a compressed gas cylinder.

3. Apparatus as set forth in claim 1 wherein said pressurized gas comprises carbon dioxide.

4. Apparatus as set forth in claim 1 wherein said expelling means comprises:
   - a frangible closed vessel containing said pressurized gas;
   - a conduit closed on one end, communicating with said cavity, and containing said closed vessel; and
   - signal responsive means operative to open said closed vessel in response to said signal.

5. Apparatus for pneumatically expelling a first body from a cylindrical cavity within a second body in a controlled manner, comprising:
   - a closure member sealingly closing said cavity from communication with the ambient;
   - a plurality of shearable pins attaching said closure member to said second body, said shearable pins having a predetermined shear strength;
   - a floating piston having first and second sides, said first side being positioned toward said closure member and abutting said first body, said floating piston being slidably retained within said cavity between first and second positions and sealingly engaging the walls of said cavity;

a source of pressurized gas having an initial pressure greater than a preselected minimum; and expelling means communicating with said source and said cavity, and responsive to a signal, for pressurizing said cavity on said second side of said floating piston;

whereby the force on said piston resulting from pressure applied to said second side by said expelling means exceeds said predetermined shear strength and causes said shearable pins to fail in shear and release said closure member and first body.

6. A buoyant flare launching system, comprising:

a first cylindrical body having a central axis and a plurality of cylindrical cavities, open on one end, arranged in parallel axial alignment about said central axis;

a plurality of closure members, one for each cavity, releasably attached to said first body in sealing engagement with said first body at each cavity, and sealing each cavity from communication with the ambient;

a plurality of forcing pistons, one for each cavity, each piston being retained within its respective cavity in sealing relationship with the walls of that cavity, and slidable between first and second positions;

a plurality of pressurizing mechanisms, one for each cavity, each mechanism communicating with one of said cavities and having a source of compressed gas, and injection means responsive to a launch signal for injecting said compressed gas into said one of said cavities; and an electric circuit within said first body for sending launch signals to said plurality of injection means, one at a time, in a predetermined sequence in response to predetermined actuation signals.

7. A system as set forth in claim 6 wherein said injection means comprises an electrically actuated gas generating squib positioned to generate gas within said pressurizing mechanism, a spiked piston configured and positioned to be propelled by said generated gas, and said source of compressed gas being contained within a frangible container.

8. A system as set forth in claim 6 wherein said compressed gas comprises carbon dioxide.

9. A system as set forth in claim 6 wherein said forcing pistons have first and second sides, said first sides being positioned toward said closure members, said pressurizing mechanisms being operative to pressurize said second sides of said forcing pistons.

10. Apparatus for pneumatically expelling a first body from a cylindrical cavity within a second body wherein said cavity is defined by interior walls and is sealed from communication with the ambient by a detachable seal, said apparatus comprising:

a floating piston having first and second sides, said first side being positioned toward said seal and abutting said first body, said floating piston being slidably retained within said cavity between first and second positions and sealingly engaging the walls of said cavity a source of pressurized gas;

a frangible closed vessel containing said pressurized gas;

a conduit, closed on one end, communicating with said cavity, and containing said frangible closed vessel;

an electrically initiated gas generating squib attached to said conduit and configured to generate gas within said conduit in response to a signal; and a piston positioned in sealing engagement with the inner surface of said conduit, said piston having a spike directed away from said squib and toward said frangible closed vessel;

whereby said squib generating gas in said conduit in response to said signal propells said spiked pistion into said frangible closed vessel, puncturing the vessel and releasing pressurized gas to flow through said conduit into said cavity pressurizing said second side of said floating piston and thereby expelling said first body from said cavity through said detachable seal.

11. Apparatus for pneumatically expelling a first body from a cylindrical cavity within a submerged second body wherein said cavity is defined by interior walls and is sealed from communication with the ambient by a detachable seal, and wherein said apparatus provides recovered buoyancy, said apparatus comprising;

a floating piston sealingly engaging said cylindrical cavity interior walls and being restrained to sliding motion between first and second positions within said cylindrical cavity, said floating piston having first and second sides and dividing said cylindrical cavity into forward and aft cavities wherein said forward cavity is partially defined by said first side of said piston and is configured to contain said first body, and said aft cavity is partially defined by said second side of said piston, said forward cavity having a volume which decreases and said aft cavity having a volume which increases as said floating piston slides from said first position to said second position;

a source of pressurized gas; and expelling means communicating with said source of pressurized gas and with said aft cavity, and responsive to a signal for pressurizing said aft cavity;

whereby said expelling means pressurizes said aft cavity in response to a signal, forcing said floating piston from said first position to said second position, thereby pushing said first body past said detachable seal, flooding said forward cavity, and reducing the volume of said flooded forward cavity resulting in first body expulsion and recovery of buoyancy of said second body.

* * * * *